US005232513A

United States Patent [19]

Suratt et al.

[11] Patent Number: 5,232,513

[45] Date of Patent: Aug. 3, 1993

[54] ENGINE CLEANING PROCESSES

[76] Inventors: Ted L. Suratt, 8425 Wakulla Dr., Tampa, Fla. 33637; Jeffrey R. Holtz, 14 Country Club Dr., Greer, S.C. 29651

[21] Appl. No.: 751,153

[22] Filed: Aug. 28, 1991

Related U.S. Application Data

[63] Continuation-in-part of Ser. No. 375,193, Jun. 30, 1989, abandoned.

[51] Int. Cl.[5] ..... B08B 3/08; B08B 5/04; B08B 9/00

[52] U.S. Cl. ..... 134/21; 134/22.1; 134/22.18; 134/22.19; 134/26

[58] Field of Search ..... 134/10, 21, 22.12, 22.14, 134/22.18, 22.19, 26, 40, 22.1; 123/196.R, 196 A

[56] References Cited

U.S. PATENT DOCUMENTS

| | | | |
|---|---|---|---|
| 1,696,100 | 12/1928 | Osborne | 134/22.19 |
| 1,751,053 | 3/1930 | Osborne | 134/22.19 |
| 2,366,073 | 12/1944 | Vallerie | 134/21 |
| 2,454,585 | 11/1948 | Alderman | 134/10 |
| 2,493,120 | 1/1950 | Eaton | 134/21 |
| 2,896,645 | 7/1959 | Iwasaki | 134/21 |
| 3,431,145 | 3/1969 | Riley | 134/22.19 |
| 4,140,543 | 2/1979 | Soleri et al. | 134/22.18 |

*Primary Examiner*—Theodore Morris
*Assistant Examiner*—Saeed T. Chaudhry
*Attorney, Agent, or Firm*—Hardaway Law Firm

[57] ABSTRACT

An engine cleaning apparatus and process for removing contamination from internal oil passages, internal water passages, internal air/fuel passages, and internal exhaust system passages of an internal combustion engine comprising a pump working in communication with a fluid supply line and a fluid return line to pump and vacuum a solvent fluid through the passages of the engine.

5 Claims, 6 Drawing Sheets

ENGINE CLEANING PROCESSES

This application is a continuation-in-part of application Ser. No. 07/375,193, filed Jun. 30, 1989, abandoned.

BACKGROUND OF THE INVENTION

This invention relates to the art of internally cleaning the components of an internal combustion engine, to remove the buildup of contamination within. Other than metal fatigue, contamination is the root reason that an engine will wear out and fail. If an engine is kept clean of internal contamination, it will last, as much as, three times longer than its counterpart which is not privy to the preventative maintenance provided by this invention's processes. The following text is divided into section which address the specific processes individually.

INTERNAL OIL PASSAGES AND MECHANICAL ANALYZATION

Background

This invention relates generally to the art of engine cleaning and mechanical analyzation and more particularly to the art of removing the sludge, varnish, and carbon from internal oil passages, and the mechanical analyzation of the wear on the main and rod bearings and the oil pump and screen of an internal combustion engine.

To date, it appears that the potential of this process and the benefits derived from it have been largely overlooked. The currently used method for cleaning the internal oil passages in an internal coubustion engine involves removing and disassembling it, submerging it in a cleaning solution, and then re-assembling and re-installing it. This is a very time consuming and expensive procedure, and requires the skill of a well trained mechanic. Because of the cost and time involved, the contamination that accumulates inside an engine is not removed until the engine quits or develops serious trouble. Therefore, the engine experiences a significant amuont of wear that it normally would not have, if the contamination was removed when needed. Further, the mechanical condition of the main and rod bearings and the oil pump and screen can only be checked by disassembling the engine.

It is another object of this invention to provide a novel process for cleaning the internal passages and restoring the heat transfer properties of the cooling system of internal combustion engines.

COOLING SYSTEM PROCESS

Background

It has been found that the current methods being utilized today for the cleaning of the cooling system in an internal combustion engine are not designed to cure the root of the problem. Long before the cooling system becomes clogged or the flow of solution through it is restricted to the point of rasing the solution temperature beyond normal, clacium, lime and rust is forming on the interior passages of the engine block, heater core and radiator, restricting the heat transfer properties of the engine to transfer the heat of the combustion process to the cooling solution, causing the engine block itself to retain excess heat and pass it on to the oil and the internal parts.

There are various different processes being used today for cleaning the cooling system in engines. 1. The power-flush; a simple procedure that utilizes ordinary water to flush the cooling system of the old antifreeze solution and filling it back up with new antifreeze solution. This does absolutely nothing to remove any rust, calcium, or lime. 2. Chemical flush; a store bought product, usually provided in sixteen ounce containers, that one wuold add to the cooling system and operate the engine for a specified period of time, drain out, poer-flush, and fill with new antifreeze. The strength of the final solution used to circulate through-out the cooling system and the method of circulating the solution is not adequate to remove the calcium and lime, and is only negligible on the rust. 3. Chelating system; this process is usually accomplished by means of a machine which contains several filters and a pump. The antifreeze solution in the cooling system is cycled through the machine several times. During the cycles, the free contaminants within the solution are filtered from the antifreeze. These machines also operate on a completely closed system, therefore, circulating pressure msut be kept down and without pulsation, to ensure that the cooling system components are not over pressurized. After completion, new inhibitores, dye, and lubricants are added to the filtered antifreeze to bring it to its original properties. This process also does nothing for the calcium and lime that is attached to the interior surfaces. None of these systems actually restore the heat transfer properties of the engine block and related accessories to their original state.

Antifreeze solution is comprised primarily of ethylene glycol, which does not change checmically within the cooling system of an engine, with inhibitors added to control rust and lubricants added to overcome the friction created when the calcium and lime that is present in tap water is deposited within the cooling system. If a cooling system is treated with a proper acidic solution to remove the rust and scale build-up and treat the metal within to prevent further oxidation, the need for inhibitors is no longer present. As ethylene glycol is a natural lubricant itself, ne of such a degree to provide proper lubrication to a water pump that does not have any build-up of scale, additional lubricants are no longer necessary.

CATALYTIC CONVERTER PROCESS

Background

To date there has not been a method for the periodic cleaning of a catalytic converter. When one becomes clogged or poisoned with the excess carbon and sulphur deposits, it has to be removed and replaced or have the beads drained and replaced. Most newer catalytic converters do not contain beads and are of a throw away design. This results in costly and time consuming repair work. Like all modern equipment, a preventative maintenance procedre is necessary, to prevent costly repairs and maintain optimum performance.

It is another object of this invention to provide a novel process for removing the carbon and sulphur build-up inside a catalytic converter and returning the exhaust flow of an engine back to its normal back pressure rating.

FUEL SYSTEM PROCESS

Background

There are numberous methods on the market today to clean the fuel induction systems of gasoline internal combustion engines. The most popular used is of a variety defined in U.S. Pat. No. 4,671,230 by Turnipseed, of which many manufacturers have a version of. This method is not adequate to clean the entire fuel induction system, only the internal route of the fuel injectors themselves and a small portion of the residue building up inside the other passages of the fuel induction system. If the fuel filter is in place, the internal routes of the fuel injectors themselves will be free of obstructions. The clogging occurs on the tips of the fuel injectors that protrue into the intake manifold. The theory behind this type of cleaning is to inject a small amount of concentrated cleaner into the fuel system via the fuel input port at the intake manifold. This cleaner would then spray inside the intake manifold in place of the regular fuel and clean the fuel passages concurrently as it completed its cycle thru the engine during its combustion process. In the case of severely carboned systems and carboned up intake valves and manifolds, these methods do not have the power or quantity of cleaning fluid to completely accomplish the job. Carbon depositing on the backside of intake valves requires more contact with the cleaning fluid than is injected through the induction port. Carbon build-up inside the intake manifold will change the air/fuel ratio to a richer than needed mixture, even though the vehicles onboard computer is constantly adjusting to obtain the perfect ratio of 14.7:1. This is because the computer is dependent on a fully open air passage in the intake manifold. This build-up will decrease the amount of air flowing through the manifold by reducing its sizze and creating friction on the air flow. Thus, when the engine increases speed and more fuel is regulated into the manifold, the proportioned amount of air that the computer relies on to be there is not. An increase of carbon build-up occurs on the backside of the intake valve, due to the valve not seating properly. This is a problem that has been extensively occurring on modern vehicles for several years now, and the conventional methods of cleaning are not doing the proper job.

SUMMARY OF THE INVENTION

It is thus an object of this invention to provide a novel apparatus for cleaning the internal oil pasages of an internal coubustion engine and also an object of this invention to analyze the mechanical condition of the main and rod bearings and the oil pump and screen.

It is a more particular object of this invention to provide a novel process to mroe quickly, effectively, and at a reasonable expense, clean the internal oil passages, and analyze the machanical condition of the main and rod bearings, and the oil pump and screen, of an internal combustion engine.

It is another object of this invention to provide a novel process for cleaning the intenal passages and resotring the heat transfer properties of the cooling system of internal combustion engines.

It is another object of this invention to provide a novel process for removing the carbon and sulphur build-up inside a catalytic converter and returning the exhaust flow of an engine back to its normal back pressure rating.

It is yet another object of this invention to provide an apparatus which can be used to clean the fuel system of an internal combustion engine.

These as well as other objects are accomplished by an apparatus used for cycling and filtering solvent under pressure through passages of an internal combustion engine, thereby cleaning them. The apparatus also cycles oil through the internal oil passages to analyze the condition of the mechanical parts by using the back pressure created as references. The apparatus comprises a pump, a fluid source, fluid supply and return lines, switching valves and analytical guages, and means for connecting the fluid supply line to the internal passages of an internal combustion engine.

DETAILED DESCRIPTION

Oil Passages Process

Figure 1:
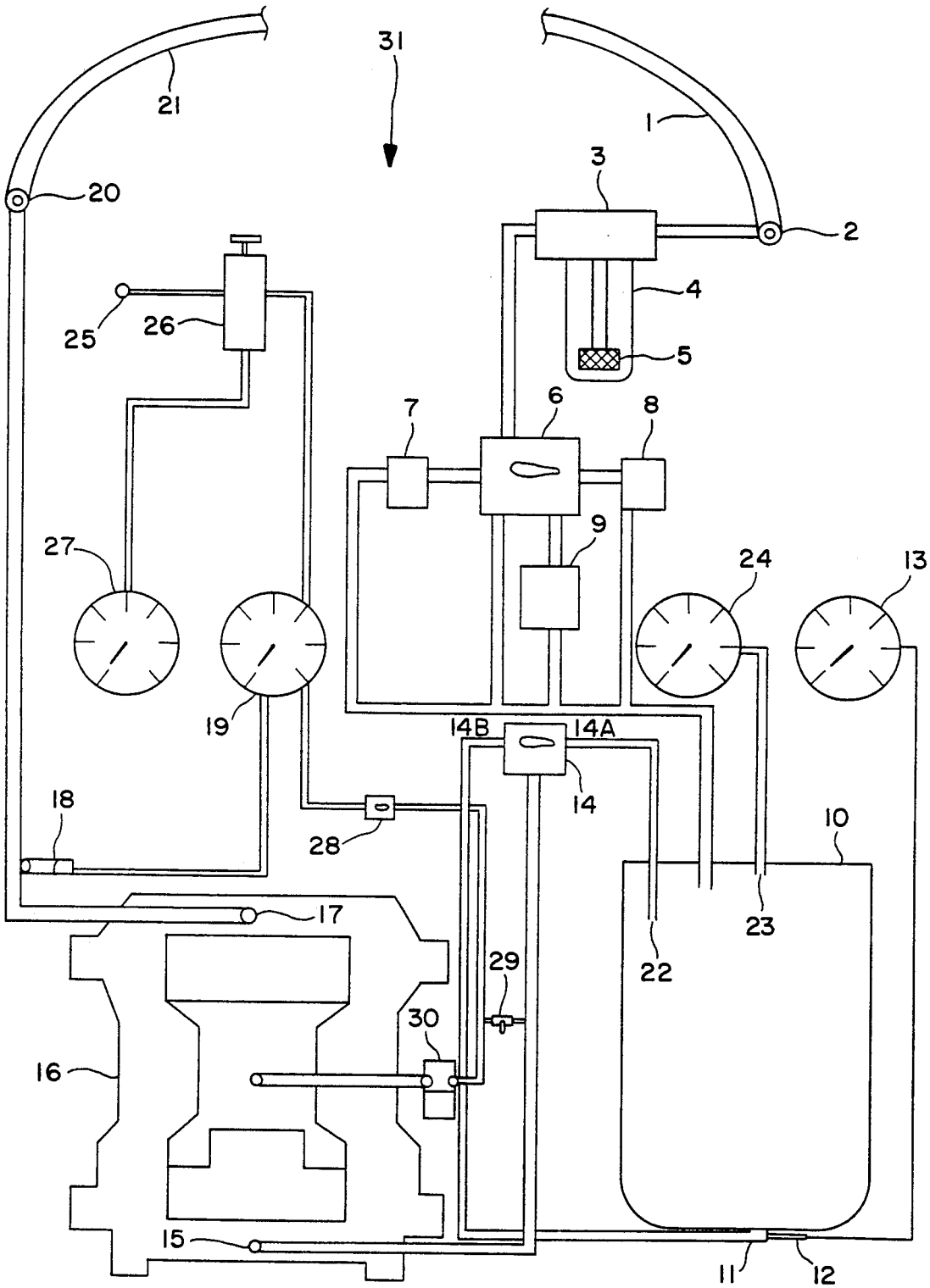
FIG. 1 is an internal schematic drawing of the engine cleaning apparatus.
Figure 2:
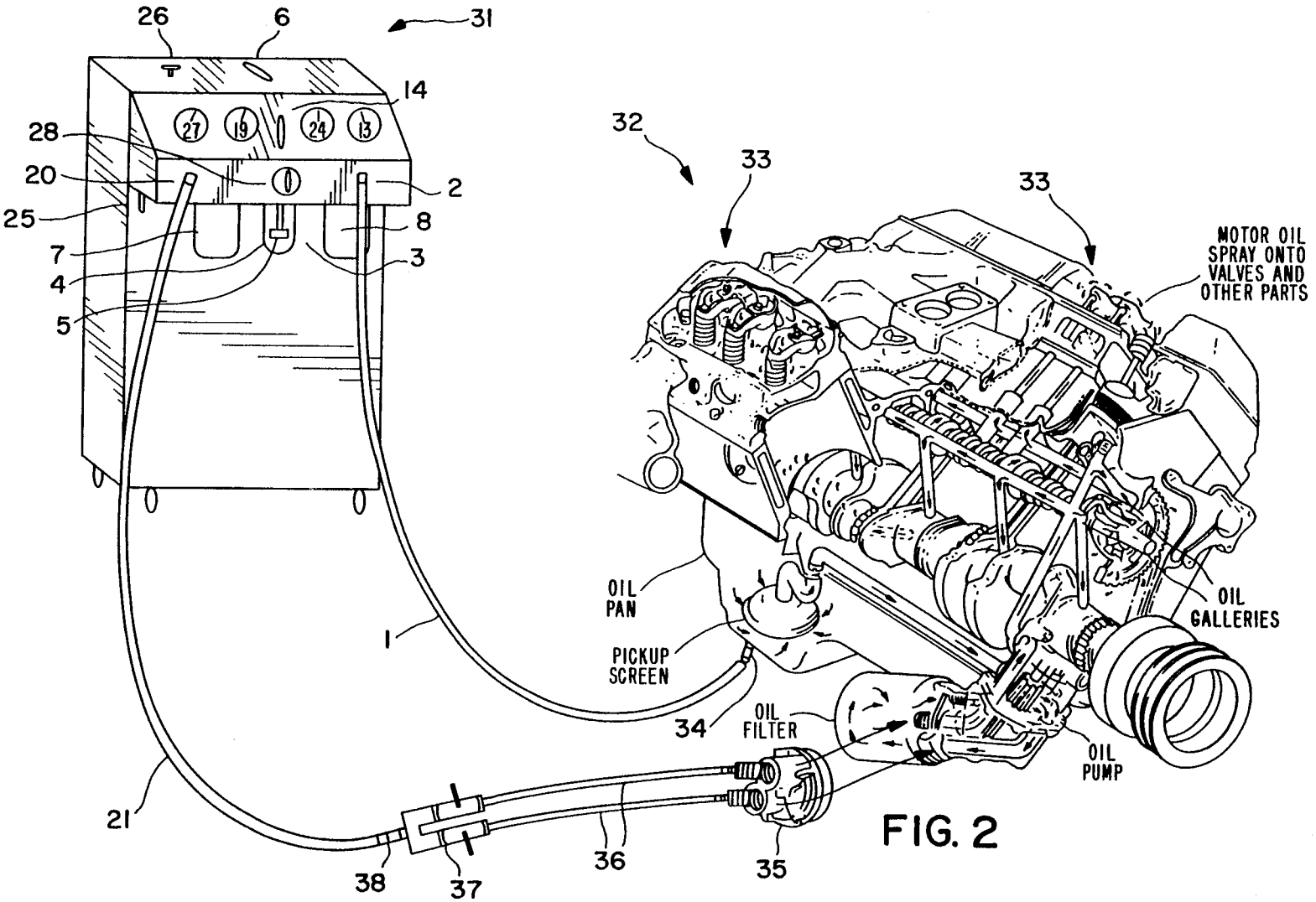
FIG. 2 is a perspective view of the engine cleaning apparatus as used to clean the oil passages of an internal combustion engine.

This object of the invention is carried out by attaching solvent supply lines to the external openings of the oil passages on an engine block, initiating air pressure to power the pump which forces solvent through the oil passages and vacuums it out of the oil drain plug opening, filters and then recycles the solvent until the contamination is removed. The solvent is then removed from the machine and is replaced with oil. The oil is then circulated to re-lubricate the engine and analyze the condition of the main and rod bearings and the oil pump and screen. These procedures require no extensive training and can be performed by most anyone of ordinary skill.

It has been found that the apparatus of this invention may be utilized to remove the by-products of motor oil that chemically break down under the heat and pressure of an internal combustion engine and form substances commonly referred to as varnish, hard carbon, and sludge on the internal areas of an engine.

Contamination buildup in the internal oil passages will restrict oil flow. Examples are: 1. Varnish, which is the amber colored film that is deposited on the internal surfaces of the engine. Varnish is deposited inside the internal oil galleries, forming a layer, thus reducing their volume capacity and creating extra friction on the flowing oil. This is especially detrimental on the action of the lifters. Varnish is deposited on the exposed areas of the wrist pins that attach the piston to the connecting rod and slowly builds up and forms into the areas of contact. This buildup requires more of the horsepower that the engine produces, to be used for its own inertia. Varnish accumulates on the surfaces of the lifters in the same manner as the wrist pins. This eventually leads to a sticky lifter. Varnish will accumulate on the rocker assemblies and valve springs, which will affect proper valve timing by delaying the closing of the valves.

2. Hard carbon, which is the black crusty substance that is left after the separation of the varnmish in the oil, forms on the exposed areas inside the engine and is held in place by more varnish depositing onto the surfaces. Periodically this substance can break loose from the flow of the oil and be washed down into the oil reservoir, where it will be drawn into and wedged in place in the draw tube screen that is attached to the oil pump in the oil reservoir. This restricts the oil pump's ability to draw the required amount of oil into the oil pump, which in turn feeds the oil to all the internal parts that require lubrication.

3. Sludge is a very thick mixture of the hard carbon, varnish, and condensation from the atmosphere. When an engine is not operated at full operating temperature for extended periods of time, the moisture present in the atmosphere will emulsify with the detergents in the oil and form the sludge. This substance will form on the top surfaces of an engine and restrict the draining of the oil down into the reservoir.

The buildup of these contaminants will restrict oil flow, decrease lubrication, and increase friction and operating temperature; which will in turn increase the wear on moving parts, affect valve timing, decrease useful horsepower, increase hydrocarbon emissions, and ultimately reduce the useful life of the engine. Therefore, this process can be readily used to improve the efficiency of the engine and prolong its useful life. These, as well as, other advantages will be apparent from the following description and reference to figures of drawing.

A preferred embodiment of solvent fluid according to this invention comprises high flash aromatic hydrocarbons to dissolve varnish, diacetone alcohol to dissolve varnish, ethylene glycol monobutyl either to thin sludge, and cationic surfactant to hold in suspension carbon particles that are dislodged when varnish is dissolved. A specific blend of these materials creates a powerful cleaning solvent when heated to 110 degrees Fahrenheit, is only a combustible liquid, and will break down and hold in suspension the by-products from motor oil, such as carbon and varnish.

FIG. 1 illustrates the internal schematic of the engine cleaning apparatus 31 shown in FIG. 2, 3, 4, 5, and 6 of the drawings. The major assemblies of this appartus includes a double diaphragm air operated pump 16; a fluid and vacuum reservoir system 10; four guages compromising air pressure 27, system pressure 19, vacuum pressure 24, and vluid temperature 13; fluid monitoring system consisting of a removable process hose 1, input port 2, sight glass holder 3, sight glass 4, and initial filter 5; a filter selection valve 6, consisting of a five-way valve with one input and four outputs, capable of utlilizing only one output at a time; a solvent system filter 7, a fuel system filter 8, a cooling system filter 9, a reservoir output port 11, a thermocoupler 12 connected to a temperature guage 13, a three way valve 14 with one input and two outputs capable of only one output at a time, a pump input port 15, a pump output port 17, a pressure pampener 18 that is connected to the system guage 19, an output port 20 connected to a removable process hose 21. A vacuum port 22 connected to valve 14 for the selection of vacuum during the processes, a vacuum port 23 for the guage 24 to operate. An air supply system consisting of an input 25, regulator 26, on/off switch 28, purge valve 29, and lubricator 30;

FIGURE ONE — PART ONE

A standard air supply hose commonly found in auto garages (not shown), is connected to the air input connection 25 where the air can travel via air line to regulator 26. From the regulator 26 the air will activate an air guage 27 which will give constant readings of the air passing thru the regulator 26. From the regulator 26, the air will travel, via air lines, thru an on/off switch 28, further thru an air tool lubricator 30, and connect to a double diaphragm air operated pump 16.

FIGURE ONE — PART TWO

Figure 3:
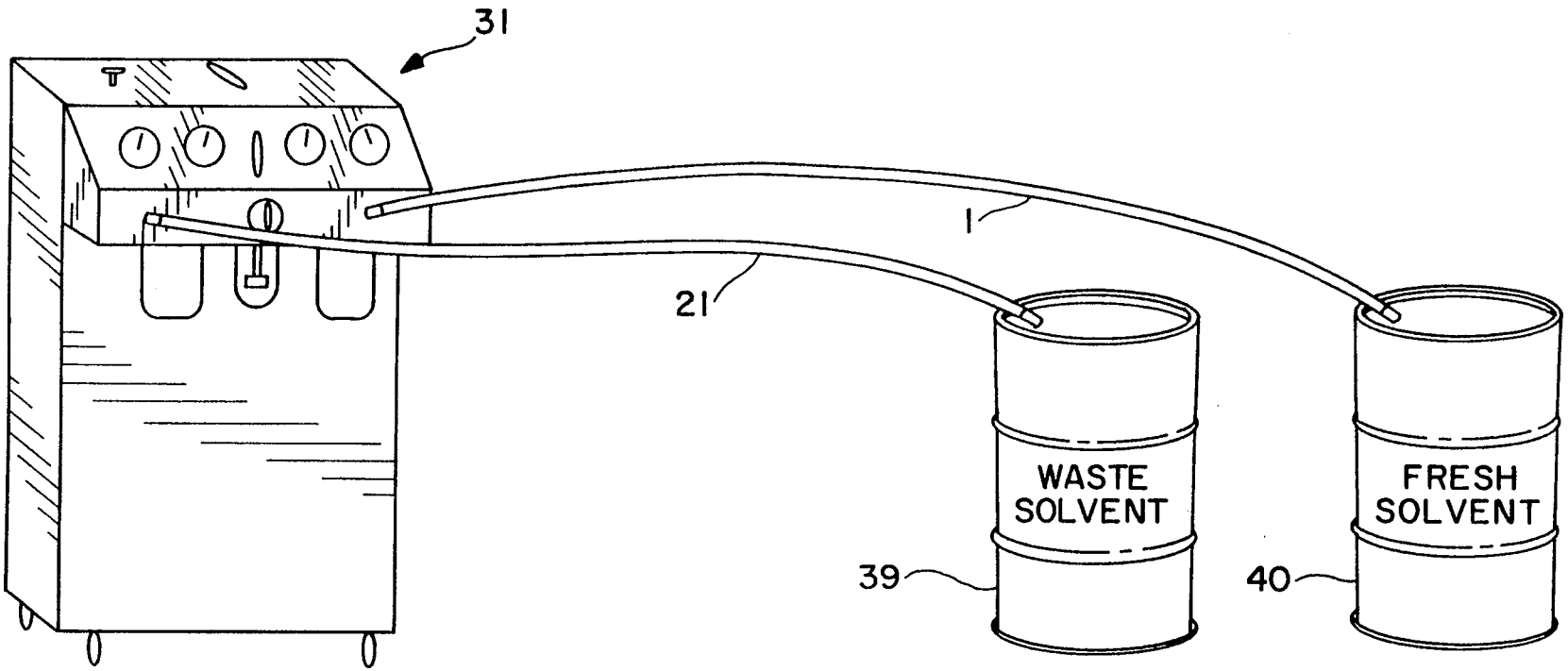
FIG. 3 is a perspective view of the engine cleaning apparatus being used to collect fresh solvent fluid.
Figure 4:
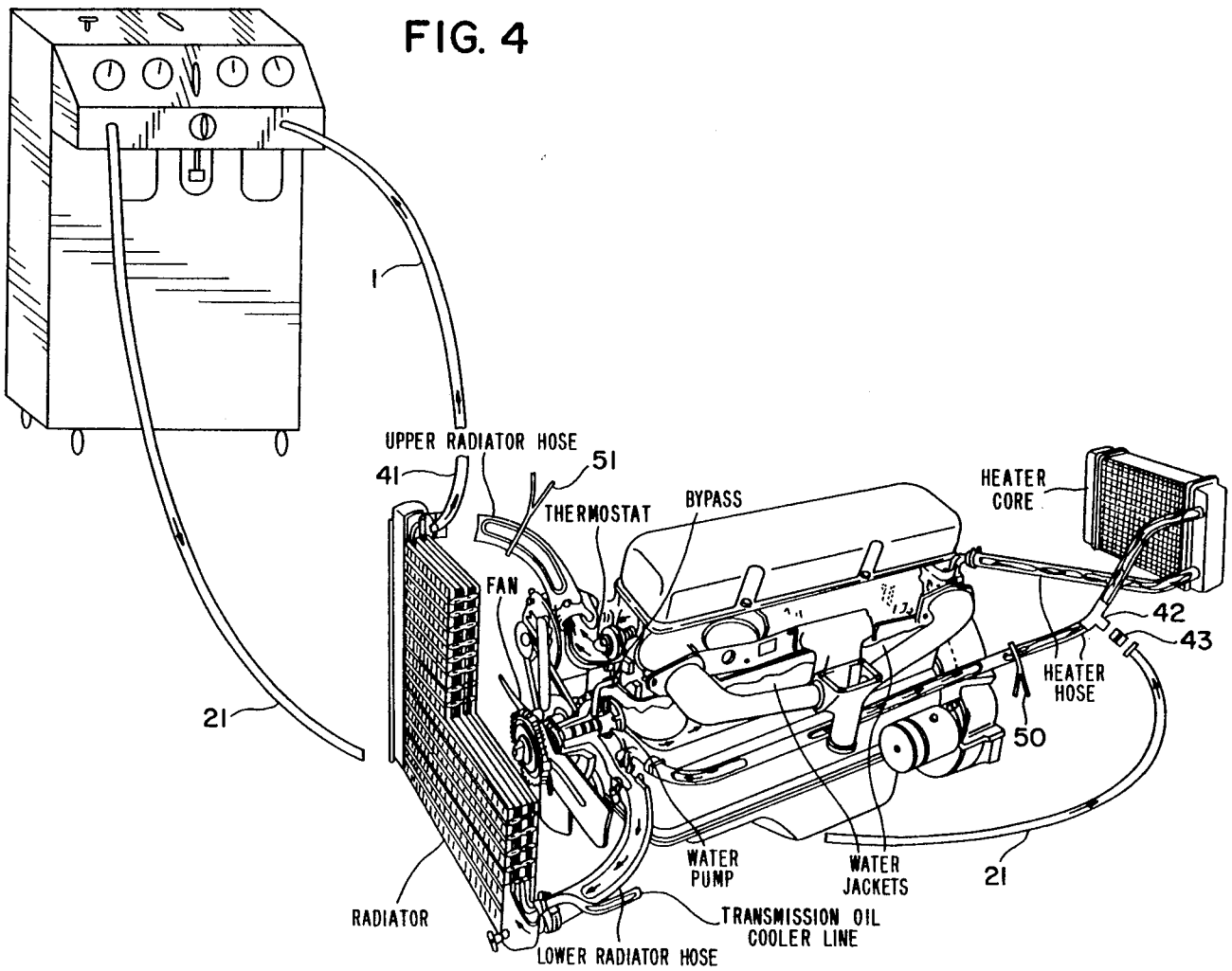
FIG. 4 is a perspective view of the engine cleaning apparatus as used to clean the cooling system of an internal combustion engine.
Figure 5:
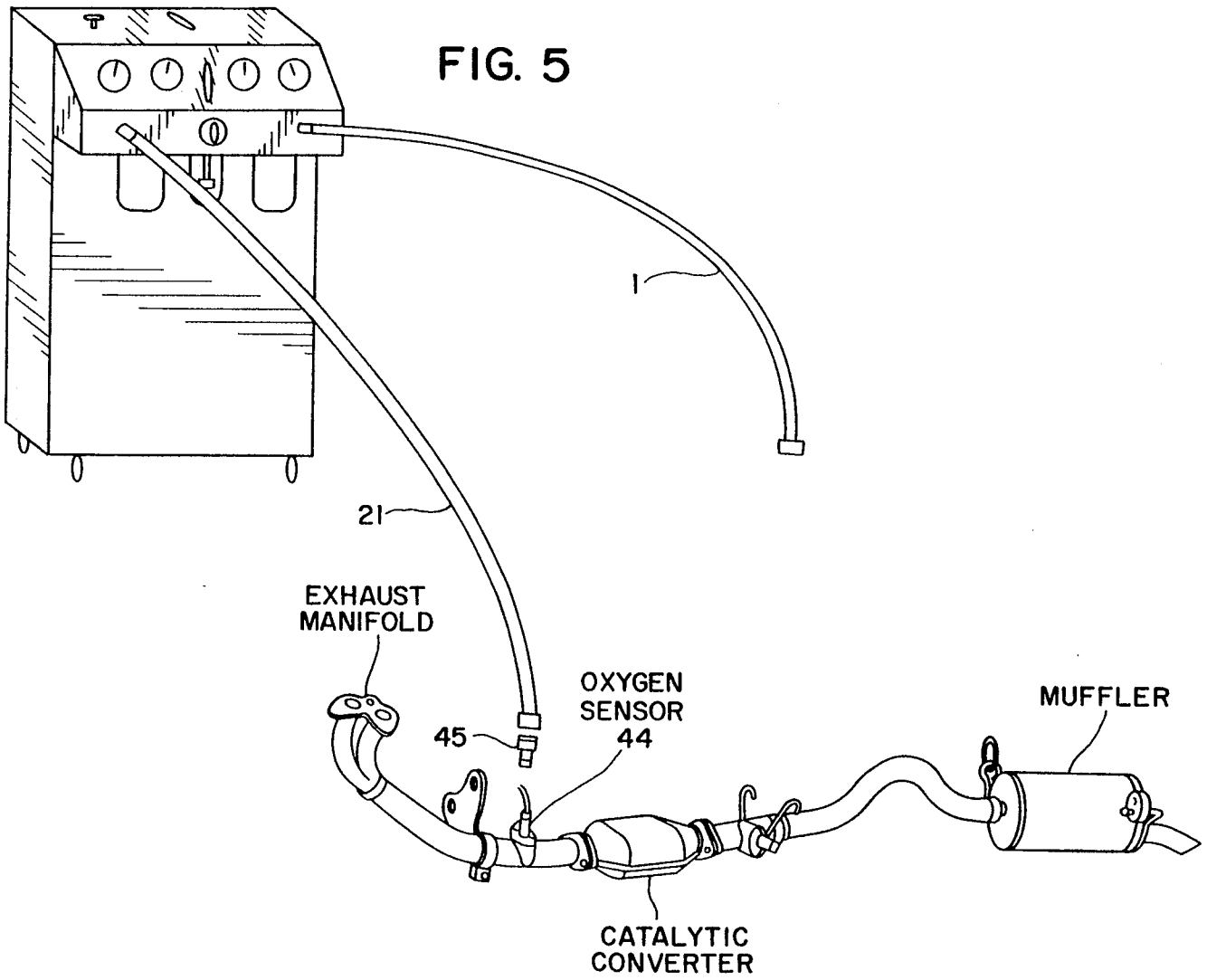
FIG. 5 is a perspective view of the engine cleaning apparatus as used to clean a catalytic converter.
Figure 6:
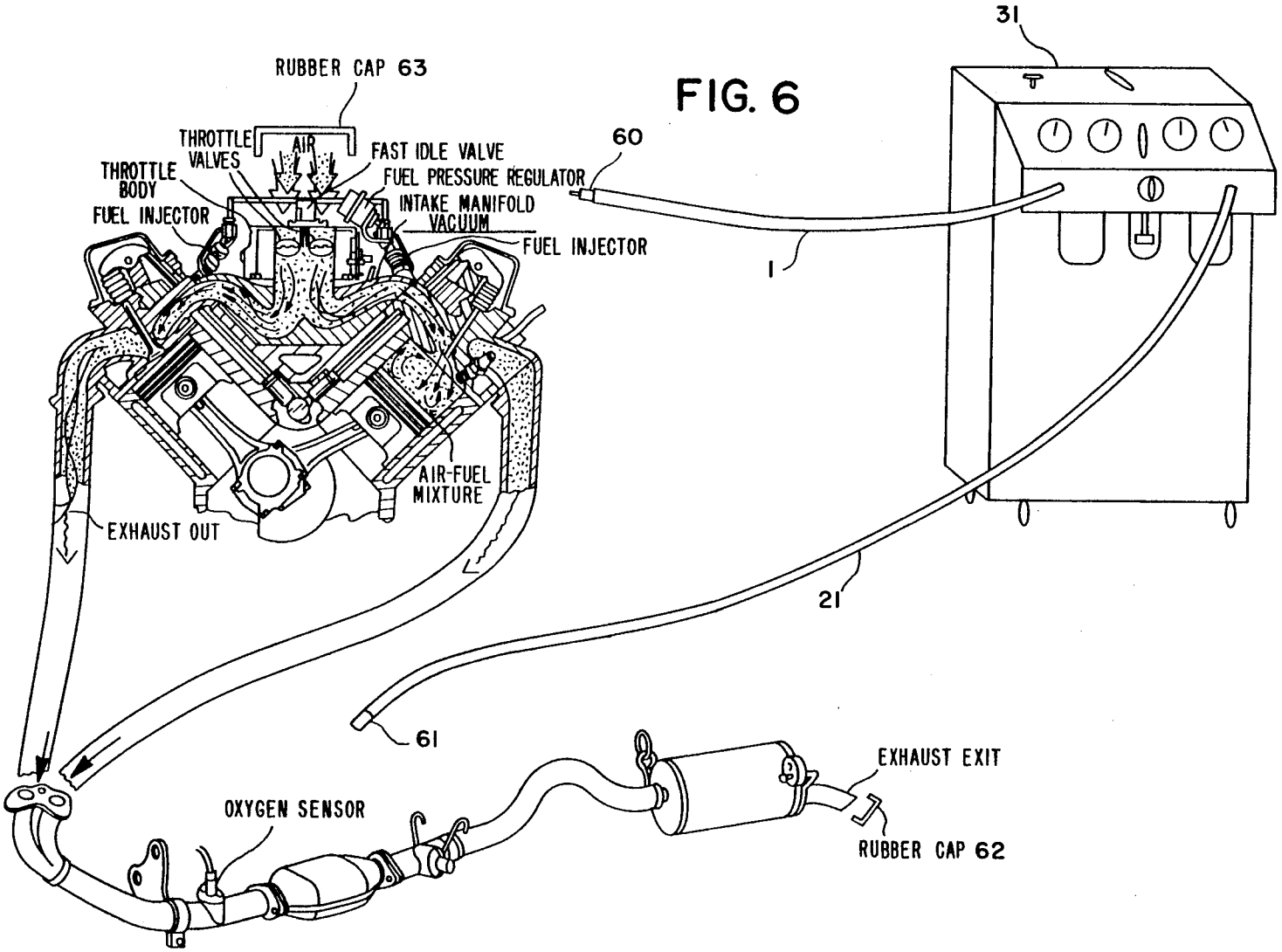
FIG. 6 is a perspective view of the engine cleaning apparatus as used to clean the fuel system of an internal combustion engine.

The cleaning solvent is vacuumed into the machine 31 by way of the input hose 1, (which is placed into a container of solvent 40, illustrated in FIG. 3), thru port 2, travels by means of a thermoplastic hose, to the fluid monitor 3, down into the sight glass 4, up thru the initial filter 5 which is composed of a 40 mesh wire screen, back thru the fluid monitor 3, travels by hose to the solvent reservoir 10. This is accomplished by switching the selection valve 14 to the vacuum position 14A, enabling the pump 16, when activated by the on/off switch 28, to draw air from the vacuum port 22 of the reservoir 10 and create a vacuum inside the reservoir 10. As a vacuum is created and solvent is filling in the reservoir 10, the vacuum guage 24 is activated thru the vacuum port 23 and measurements may be read on the face of the dial. When two gallons of solvent have been vacuumed into the reservoir 10, the level will reach the vacuum port 22 and begin to draw solvent up thru the vacuum port 22. As this occurs, the reading on the vacuum guage 24 will start to show a decrease. When the vacuum reading on guage 24 has decreased one inch of mercury, the input hose 1 is withdrawn from the solvent container 40 (FIG. 3). The pump 16 will draw the excess solvent over two gallons up thru vacuum port 22, thru selection switch 14, into itself thru port 15 and output the solvent thru port 17 which will travel thru the thermoplastic hose, pass the pressure dampener 18 which is connected to the pressure guage 19, to the output port 20, which is connected to the output hose 21 that is placed into the opening of the waste solvent container 39 (FIG. 3). The excess solvent over two gallons (approx. 8–10 ounces), is used to purge the pump of prior fluids.

FIGURE ONE — PART THREE

The cleaning solvent is pumped out of the machine 31 by selecting the gluid port 14B or selection valve 14 and activating the air supply with switch 28 to the pump 16. Solvent is then drawn out of the reservoir 10 thru the drain port 11, passes thru selection valve 14, cycles thru pump 16, and is ejected by way of port 20. Before the solvent passes into pump 16, it bypasses a thermocoupler 12 which is connected to guage 13 which reads the current temperature in fahrenheit. As the solvent is ejecting from port 19, it activ ates a pressure dampener 18 which is connected to the system guage 19. The system guage 19 will activate and show a pressure reading for the solvent, which will relate directly to the amount of back pressure restricting the solvent as it leaves port 20. As solvent is drawn from the reservoir 10, a vacuum is created within. The only relief for the vacuum void created is thru the filter 7, 8, or 9, following up thru the filter selection valve 6, thru the fluid monitor 3 and to the input port 1. With the input hose 1 (shown in FIG. 2) connected to the input port 2, a vacuum hose is created which will return the solvent that is being ejected thru port 20 back into the machine 31 at the same rate it is being ejected, providing the open end of hose 1 is in contact with the ejecting solvent. This will create a complete cycle of the solvent.

FIGURE TWO

Figure two illustrates the machine 31 connected to an internal combustion engine 32 of the style found in automobiles. Hose 21 is connected to a two-way switching valve 37 by means of a flared, threaded hose connector 38. The valve 37 consists of one input and two outputs, each output working independently of each other. The valve 37 has permanently attached to it two output hoses 36, which possess flared, threaded hose connections at the free ends. The hoses 36 are connected to an adapter 35. The adapter 35 is attached to the engine block in the same fashion as an oil filter, by a threaded tube protruding from the engine block of which the adapter 35 has a threaded female opening for it to fasten to. Adapter 35 connects to the engine block and provides two distinct routes for the solvent to flow into the engine. One opening connects to the opening in the block where oil flows from the oil pump to the filter housing, and one opening directs the oil flow to the internal passages of the engine, starting at the crankshaft, main and rod bearing, and upwards from there to the top of the engine. Hose 1 connects from the input port 2 of the machine 31 to the oil pan drain plug opening of the engine by means of a threaded adapter 34. This adapter 34 has male threads on each end to properly fasten into the drain plug opening and also to hose 1. Hoses 36 will disconnect at adapter 35 easily to be placed into the openings of the valve covers 33, if additional flow of solvent is necessary to completely cleanse the top of the engine.

FIGURE THREE

Figure three illustrates how the machine 31 is hooked up to solvent drums 39 and 40 for filling and emptying the machine 31. Fresh solvent from drum 40 is vacummed into the machine 31 and waste solvent is pumped into the waste drum 39 after use.

OPERATIONAL PROCEDURES

The machine is connected as illustrated in figure three and two gallons of solvent are vacuumed into the machine as figure one-part two describes. The machine is then connected up as illustrated in figure two to an internal combustion engine.

The process is started as described in figure one-part three. Refer to figure two for the following procedures: with the valve 37 open on both sides, solvent will begin to flow into the engine and follow both directions of travel within. It should be added here that the engine is at proper operating temperature, the filter is removed, and the oil has been drained prior to starting this procedure. As the solvent passes through the engine, it will extract the heat from the engine block and raise the temperature of the solvent to approx. 120–140 degrees fahrenheit. This increases the cleansing ability of the solvent and requires no additional heating apparatus. As the solvent is returned to the machine, it will be visible through the sight glass 4. All large carbon particles will be retained in the glass by means of the prefilter 5. As the machine reaches the stage of fully cycling the solvent, observe the system pressure readings on guage 19. The reading will indicate the amount of back pressure created on the machine resulting from the clearance in the main and rod bearings and also the oil pump. The operator now has the ability to close alternately each side of valve 37 and isolate the solvent flow to each individual route, as described in figure two. This will enable precise readings on the system pressure for the oil pump and screen, and on the main and rod bearings. Since the solvent used is of a lower viscosity, the readings at this point are for the operator's use in determining if there is any severe blockage in the oil routes. If there is, he is able to increase pressure and quickly dissolve the blockage. The process is run for 15 minutes and the sight glass is removed and inspected for carbon and sludge. The varnish has been dissolved by this time. If there is any contamination in the sight glass, the process is continued until it is all dissolved.

At this point, the solvent in the machine is pumped into the waste drum as outlined in figure three. One and a half to two gallons of used oil is then vacuumed into the machine. The machine is then re-connected in the same manner as the cleaning process, and the oil is circulated throughout the engine to purge it of any remaining solvent and re-lubricate all oiled parts. Valve 37 is used at this time, in the same manner as outlined above with the solvent, to check the pressure readings on the internal components. When completed, the oil is vacuumed out and new oil and filter is added.

It is thus seen that the invention provides a novel apparatus for cleaning the internal oil passages and mechanical analyzation of the main and rod bearings and the oil pump and screen of an internal combustion engine. It is further seen that this invention provides a novel process whereby an internal combustion engine can be easily and quickly cleaned and analyzed without having to remove and disassemble the engine.

This object is accomplished by using the apparatus to circulate a concentrated acidic solution throughout the cooling system, filtering the solution on each pass thru the machine. The apparatus consists of an air powered pump, fluid reservoir, fluid supply lines, filtering system, switching valves, and monitoring guages. A concentrated solution is pumped into the system and circulated with a pulsating pressure to remove and dissolve all calcium, lime, rust and other contaminants. During that circulation, the cleaning solution is following a one way — reverse flow pattern. This procedure requires no extensive training and can be performed by most anyone of ordinary skill.

DETAILS OF DRAWING — FIG. 4

Figure four details the connections involving the cooling system process. Hose 1 of machine 31 is connected to special hose 41 which is placed into the opening of the radiator. Hose 21 is connected to adapter 43 which connects to a flush tee 42 inserted into the heater hose. Pliers 50 and 51 are placed on hoses to prevent normal circulation.

OPERATIONAL PROCEDURES

The radiator is vacuumed out utilizing the machine and filtering system (or manually drained and filtered with the machine in teh case of vertical flow radiators) and placed into a holding container. Two quarts of concentrated cleaner is placed into the radiator and the engine and heater started. As the engine is warming, water is added to the radiator until it is full. The engine is turned off before reaching operating temperature. A clamp pliers is placed on the heater core line in between the flush tee and water pump. Another clamp pliers is placed on the upper radiator hose between the thermostat outlet and the radiator. The machine is turned on to circulate the fluid into the heater core, throughout the engine block, and into the radiator where it is returned to the machine for filtering and re-circulation. The process is operated for a minimum of 15 minutes, and then until the solution being returned to the machine is free of sediment thru the fluid monitor. The solution is then pumped out of the machine while vacuuming out the radiator. A water hose is connected to the flush tee and the system is back flushed with water to insure all contamination has been removed. The water is then vacuumed out of the system and the original antifreeze solution is reinstalled.

In accordance with this invention it has been found that the apparatus of this invention may be utilized to remove the calcium, lime, rust and other contaminants within the cooling system of an internal combustion engine, treat the internal passages of the cooling system to prevent any further oxidation, has the ability to operate under pulsating pressure without exerting undue pressure on the engine's components, and restore the heat transfer properties of the engine's cooling system to their original state.

It is thus seen that the invention provides a novel process for cleaning the interior passages of the cooling system of internal combustion engines. It is also apparent that the heat transfer properties of the engine are restored to their original state, and there is no risk of over pressurizing the cooling system.

CATALYTIC CONVERTER PROCESS

This object is accomplished by injecting a caustic solution into the exhaust system thru the oxygen sensor by means of a controlled pumping action generated by the machine. The engine is operated at a high idle speed during this injection of fluid. The heat generated by the exhaust gas effectively raises the temperature of the cleaning solution and creates a chemical reaction inside the catalytic converter. The deposited carbon is steamed off of the interior areas and the residual sulphur by-products are chemically turned into sodium sulfate. The deposits are removed from the screens and the beads or other filter media and are blown thru the remainder of the exhaust system. As this mixture passes thru the exhaust system and exits after the muffler, other accumulated rust and blockage is removed and the back pressure is effectively reduced to the state that it should be. This procedure requires no extensive training and can be performed by most anyone of ordinary skill.

DETAILS OF DRAWING — FIG. 5

Figure five shows the machine and a relative sample of an ordinary exhaust system of a motor vehicle. Two quarts of cleaner is vacuumed into the machine. The oxygen sensor 44 is removed and an adapter 45, which has a flor restricter inserted into it (not shown) to control the amount of cleaning fluid entering the exhaust system, is installed in its place. The pressure hose 21 is connected to adapter 45. The engine is operated at high idle and the machine is activated and allowed to pump its contents into the exhaust system at a regulated pressure. When pumping is complete, the adapter is removed and the oxygen sensor is reinstalled.

It is thus seen that the invention provides a novel apparatus for the cleaning of catalytic converters. It is further seen that the invention provides a function that isn't present in technology today for the preventative maintenance of exhaust systems, one which is quickly and easily performed at a justifiable cost to the consumer. As many variations are apparent to one of skill in the art from a reading of the above specification, such variations are within the spirit and scope of the invention as defined by the appended claims in a further section.

FUEL SYSTEM PROCESS

One quart of fuel system cleaner, composed completely of cleaning solvents that are combustible in an engine, is loaded into the MA2000. The engine is brought to operating temperature and turned off. The oxygen sensor is removed and a special adapter is connected to its place and also connected to the return hose of the MA2000. A primary vacuum input line on the intake manifold is removed and the pressure hose of the MA2000 is connected to this vacuum input by an adapter. A rubber cap is installed at the tail end of the exhaust pipe and also at the source of the air coming into the fuel induction system. These caps provide a completely enclosed system within the fuel and exhaust passages from beginning to end. The MA2000 is switched on with the flow valve in the vacuum position. THe vapors from the solvent in the reservoir will now be pressured into the intake manifold, follow the fuel passages within into the intake valves, pass through the combustion chamber and exit via the exhaust valve into the exhaust system where it is vacuumed back into the MA2000 through the oxygen sensor opening. As the solvent vapors pass through the engine, heat from the engine will be transferred to the vapors and increase their cleaning ability. Throughout this process, the engine is being slowly turned over continuously, either manually or by turning the crankshaft nut with a ratchet and socket, or by way of an optional electric motor with a belt connected to the crankshaft pulley. This allows for the vapors to pass completely through the combustion chamber and complete a full cycle. This step of the process is continued for 15 minutes. The carbon and varnish within the fuel system is being slowly dissolved and turned to a liquid state.

The next step involves removing the rubber caps from the intake source and exhaust exit openings. The adapter in the oxygen sensor housing is removed and the oxygen sensor is reinstalled. A flow restricting adapter is installed between the pressure hose and adapter which connects to the intake manifold. The engine is started and allowed to operate at a fast idle, 1500 RPMs. The flow valve on the MA2000- is switched to the fluid position, and the solvent within the reservoir is then pumped directly into the intake manifold via the pressure hose and adapter. This step continues until the quart of cleaning solvent is totally consumed by the engine. During this step the remainder of the carbon and varnish within the intake manifold, the intake and exhaust valves, and the combustion chamber, is dissolved and flushed out of the engine during its normal operating cycles. Upon completion, the MA2000 is disconnected and the vacuum line is re-connected on the intake manifold. This procedure requires no extensive training and can be performed by most anyone of ordinary skill.

DETAILS OF DRAWING — FIG. 6

The rubber caps 62 and 63 are placed into position over the respective parts and are fastened into place with clamps. The oxygen sensor is removed and a special adapter 61 is inserted into the opening, of which adapter also will readily connect to the hose 21. A direct intake manifold vacuum hose is disconnected (i.e. PCV valve or power brake line) and special adapter 60 is connected to the intake manifold in its place, of which adapter 60 will readily connect to hose 1.

It is thus seen that the invention provides a novel process for the complete cleaning of the fuel induction system on modern engines. It is further seen that the present methods do not completely clean the interior surfaces of the fuel induction system as compared to the invention. As many variations are apparent to one of skill in the art from a reading of the above specification, such variations are within the spirit and scope of the invention as defined by the appended claims in a further section.

That which is claimed:

1. The process of cleaning oil passages of an internal combustion engine comprising the steps of:

attaching a fluid supply line in communication with a solvent fluid to an oil filter attachment of an internal combustion engine;

attaching a fluid return line to an oil pan drain plug of said engine;

initiating air pressure to drive a double diaphragm air operated pump to induce a first and second flow of the solvent fluid through the oil passages and out said fluid return line, said first and second flow entering through an oil filter opening of said engine and said first flow passing through an oil pump in said engine and said second flow passing through other internal oil passages of said engine;

recycling said solvent fluid for further use.

2. The process of claim 1 wherein said solvent fluid is distributed under pressure to all oiled parts and wherein said double diaphragm air operated pump also draws air from said fluid return line to create a vacuum which vacuums said solvent fluid out of the engine as said solvent fluid is pressured into the oil passages.

3. The process according to claim 2 wherein said solvent fluid is vacuumed out of the engine at the same rate as said solvent fluid is pressured into the oil passages.

4. The process of claim 1 further comprising attaching gauges in communication with said double diaphragm air operated pump for monitoring and ascertaining pressure and wear on internal components of said engine during the process of cleaning oil passages.

5. The process according to claim 1 wherein said solvent fluid absorbs heat from said engine to maintain a temperature greater than 120 degrees Fahrenheit as said solvent fluid passes through said engine.

* * * * *